United States Patent [19]

Lunt

[11] Patent Number: 4,704,753

[45] Date of Patent: Nov. 10, 1987

[54] FITTED CRIB OR BED SHEET

[76] Inventor: Audrey T. Lunt, 6371 Vermont Hill Rd., South Wales, N.Y. 14139

[21] Appl. No.: 932,612

[22] Filed: Nov. 20, 1986

[51] Int. Cl.[4] ..... A47G 9/00

[52] U.S. Cl. ..... 5/484; 5/487; 5/502

[58] Field of Search ..... 5/484, 487, 497, 499, 5/500, 502, 495, 482

[56] References Cited

U.S. PATENT DOCUMENTS

| | | | |
|---|---|---|---|
| 2,963,715 | 12/1960 | Young | 5/497 |
| 3,321,782 | 5/1967 | Hrubecky et al. | 5/487 |
| 3,681,795 | 8/1972 | Palbnske et al. | 5/487 |
| 4,338,693 | 7/1982 | Vitale | 5/497 |

FOREIGN PATENT DOCUMENTS

| | | | |
|---|---|---|---|
| 2012159 | 7/1979 | United Kingdom | 5/484 |

*Primary Examiner*—Alexander Grosz

*Attorney, Agent, or Firm*—Michael Ebert

[57] ABSTRACT

A fitted sheet for covering a standard crib or bed mattress, the sheet being made of synthetic plastic material having an absorbent top layer laminated to a liquid-impermeable backing film whereby when a crib or bed occupant wets the sheet, the liquid is absorbed thereby, yet the underlying mattress is maintained in a dry, sanitary condition. The fitted sheet is created from a single rectangular blank whose sides are folded in on longitudinal fold lines and whose ends are folded in on transverse fold lines, the corners of the blank being folded in on diagonal fold lines to form triangular folds that are ultrasonically sealed to the folded-in ends, thereby defining a box-like fitted sheet having reinforced right angle corners and sides and ends coextensive with those of the mattress. Each end of the fitted sheet is creased to form puckers that are joined to an elastic strip to render the end stretchable whereby the fitted sheet conforms snugly to the mattress.

5 Claims, 7 Drawing Figures

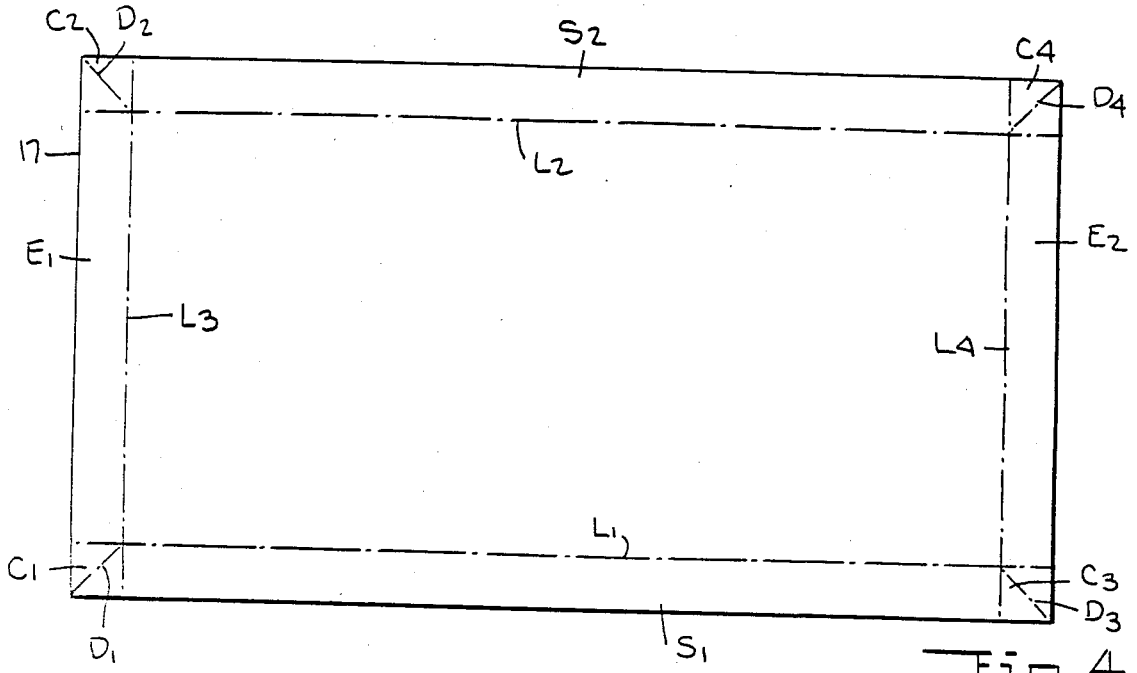
Fig. 4.
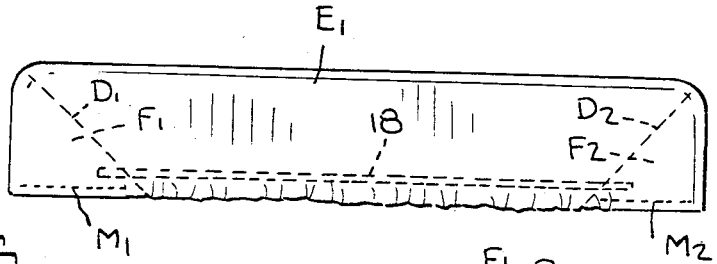
Fig. 6.
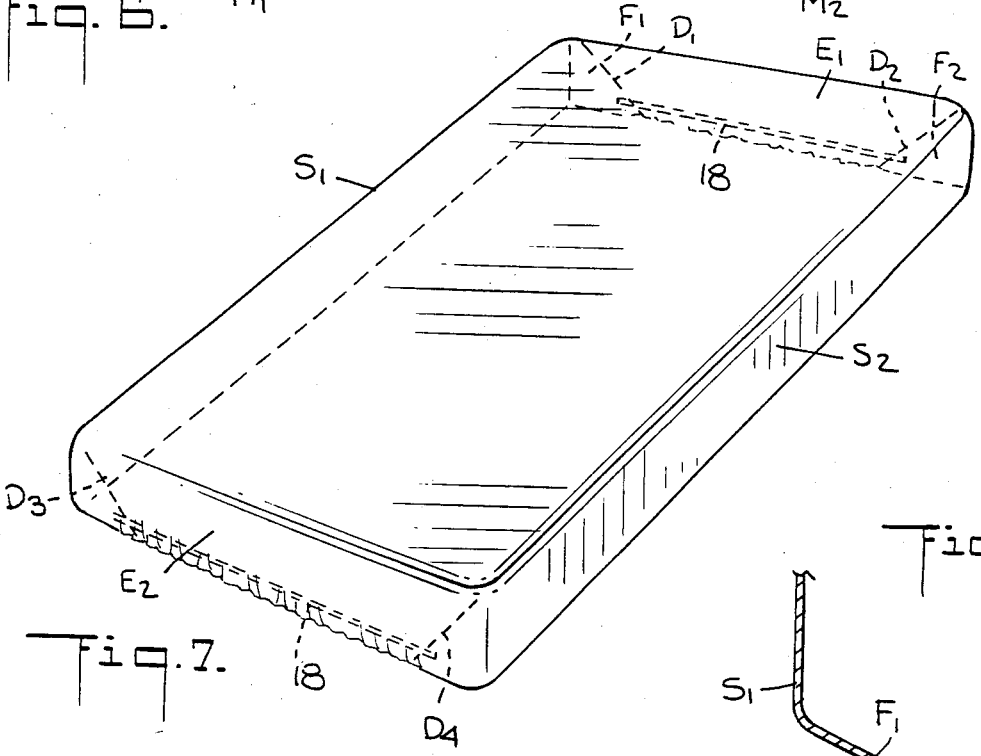
Fig. 7.
Fig. 5.
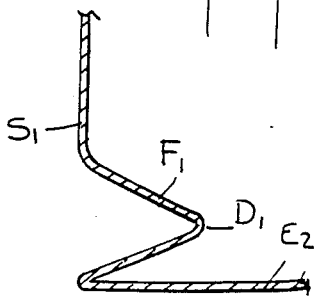

FITTED CRIB OR BED SHEET

BACKGROUND OF INVENTION

1. Field of Invention:

This invention relates generally to crib or bed sheets, and in particular to a disposable fitted sheet that snugly conforms to a standard crib or bed mattress and is constituted by material having an absorbent top layer laminated to a liquid-impermeable backing film.

2. Prior Art:

Infants and very young children are normally bedded down in a crib which is a bedstead enclosed by high slatted sides. The crib is provided with a mattress which is protectively covered by a crib sheet. Because an infant or young child occupying the crib will almost invariably wet or soil the crib sheet, the usual practice is to interpose a rubber mat between the crib sheet and the mattress to maintain the latter in a clean and sanitary condition.

Because the crib sheet is often soiled, it must be repeatedly washed, and the rubber mat must also be cleaned. The ordinary crib sheet is fabricated of cotton or other natural or synthetic textile material, or a composite thereof. In fitting the sheet to the mattress, one must manipulate the sheet to form corners which conform to the corners of the mattress.

The same problem arises with ordinary bed sheets used in hospitals, nursing homes and in other situations where the occupant of the bed is incontinent and therefore soils the sheet covering the bed mattress.

In a crib, the mattress is below the level of the slatted sides even when the sides are lowered; hence it is more difficult to form crib sheet corners than when forming corners on ordinary bed sheets. To overcome this difficulty, it is known to provide crib sheets as well as bed sheets with preformed corners, as disclosed, for example, in the Bogle U.S. Pat. No. 4,161,044. In making such fitted sheets, Bogle cuts a sheet to create a main rectangular panel and side and end panels which depend from the main panel and are sewn thereto to form right angle corners. The manufacture of such a fitted sheet requires cutting and sewing operations and is therefore relatively expensive.

The main difficulty with conventional crib sheets is that such sheets are permeable to liquid, and one must, therefore, after each use, strip the sheet off the mattress and clean it for reuse. When the infant or child occupying the crib is ill, then conventional washing procedures may not be sufficient to insure sterility and avoid possible reinfection because of inadequately cleaned crib sheets. It is for this reason that in a serious illness, even though conventional crib sheets are relatively costly, the usual practice is to dispose of the sheets after a single use.

Another problem encountered with crib sheets arises when one is traveling with a child. While many hotels and motels supply cribs having mattresses and crib sheets, one has no idea who previously occupied the crib, or whether the crib equipment is sanitary. Hence the better practice in this situation is to bring along fresh and clean crib sheets and to thereafter dispose of these crib sheets. But the cost of conventional crib sheets is such as to render this practice extravagant, particularly if more than one child is involved.

SUMMARY OF INVENTION

In view of the foregoing, the main object of the invention is to provide a fitted sheet for covering a standard crib or bed mattress, the sheet being formed of material having an absorbent fibrous top layer laminated to a liquid impermeable backing film.

A significant feature of the invention is that the fitted sheet is created without cutting or sewing from a single blank of washable synthetic plastic material which is converted into a three-dimensional fitted sheet by folding operations and ultrasonic sealing. Because the fitted sheet makes use of inexpensive material and can be made at low cost, one may dispose of the sheet after a single use, as may be desirable when sterility is of great concern, or where it is inconvenient to wash the sheet so that it can be reused. However, the nature of the fitted sheet is such that it lends itself to washing and is capable of surviving repeated washings.

Also an object of the invention is to provide a fitted crib or bed sheet having elasticized ends so that the fitted sheet conforms snugly to the mattress and is not dislodged by a restless occupant who thrashes about the crib or bed.

Yet another object of the invention is to provide a fitted sheet that makes use of inexpensive material and which can be mass produced at low cost.

Briefly stated, these objects are attained in a fitted sheet for covering a standard crib or bed mattress, the sheet being made of synthetic plastic material having an absorbent top layer laminated to a liquid-impermeable backing film whereby when a crib or bed occupant wets the sheet, the liquid is absorbed thereby, yet the underlying mattress is maintained in a dry, sanitary condition. The fitted sheet is created from a single rectangular blank whose sides are folded in on longitudinal fold lines and whose ends are folded in on transverse fold lines, the corners of the blank being folded in on diagonal fold lines to form triangular folds that are ultrasonically sealed to the folded-in ends, thereby defining a box-like fitted sheet having reinforced right angle corners and sides and ends coextensive with those of the mattress. Each end of the fitted sheet is creased to form puckers that are joined to an elastic strip to render the end stretchable whereby the fitted sheet conforms snugly to the mattress.

OUTLINE OF DRAWINGS

For a better understanding of the invention as well as other objects and further features thereof, reference is made to the following detailed description to be read in conjunction with the accompanying drawings, wherein:

FIG. 4 shows the blank from which the crib sheet is made, the fold lines being indicated by dashed lines;

FIG. 5 schematically indicates the manner by which each reinforcing corner of the crib sheet is formed;

FIG. 6 is an exterior end view of the crib sheet; and

FIG. 7 shows in perspective the outerside of the crib sheet.

DESCRIPTION OF INVENTION

Figure 1:
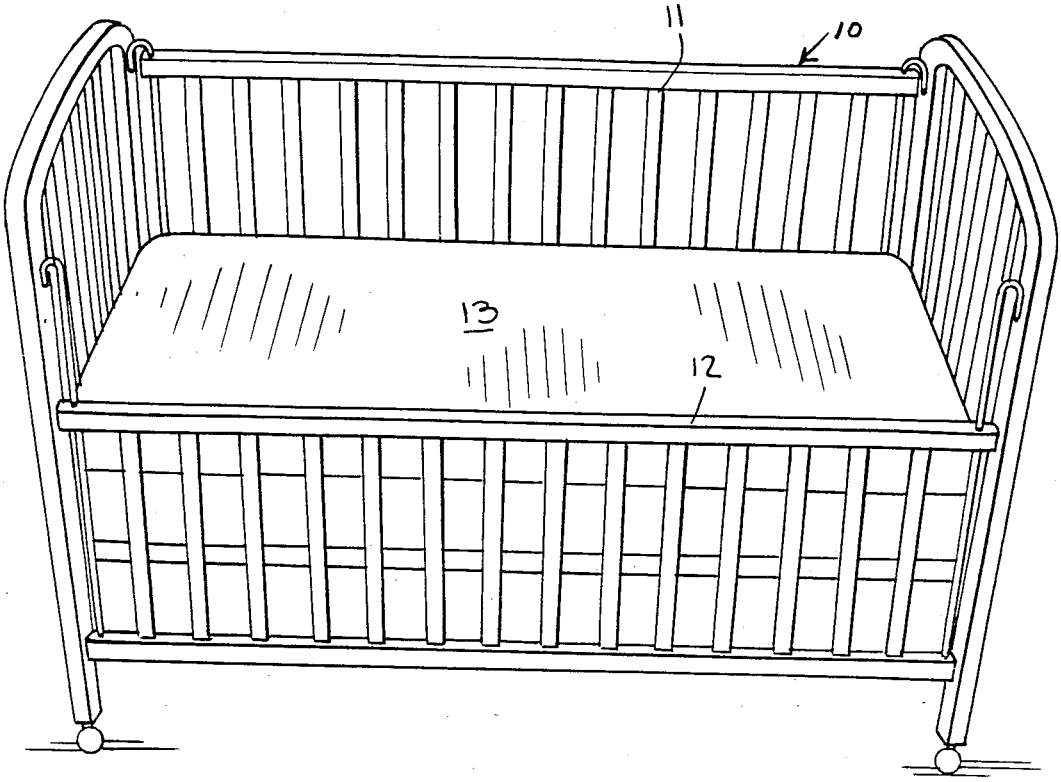
FIG. 1 is a perspective view of a conventional crib, the mattress of which is covered by a fitted crib sheet in accordance with the invention.
Figure 2:
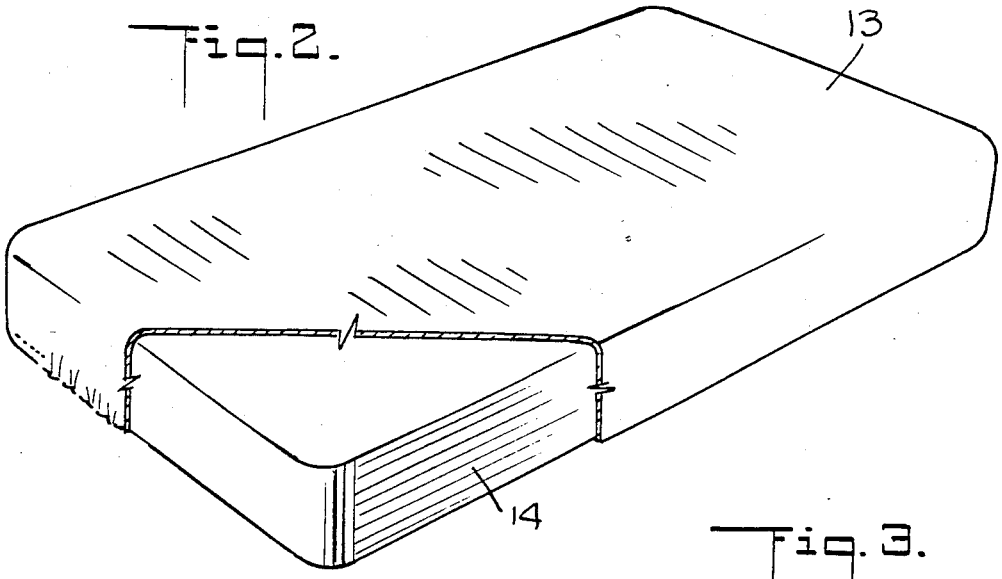
FIG. 2 is a perspective view of the crib mattress and of the crib sheet applied thereto which is cut away to expose the mattress.

Referring now to FIG. 1, there is shown a conventional crib 10 having slatted side panels 11 and 12 that can be raised to protect an occupant or lowered to provide access to a mattress which is covered by a fitted crib sheet 13 in accordance with the invention and is therefore not visible in FIG. 1. The mattress 14 is shown in FIG. 2. The dimensions for a standard mattress are 52 by 28 by 5 inches, in which case the fitted crib sheet has substantially the same dimensions.

Because the fitted crib sheet 13 has preformed corners, there is no need to make these corners when covering a mattress with the crib sheet, for one has only to fit the preformed corners of the crib sheet over the corresponding corners of the mattress.

Figure 3:
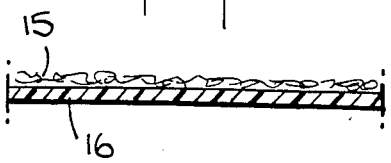
FIG. 3 is a section taken through the crib sheet material.

The crib sheet is made of a flexible synthetic plastic material, which, as shown in FIG. 3, has a top layer 15 formed of highly absorbent, non-woven fibers laminated to a non-permeable backing film 16, the material being washable. In practice, both the top layer and the backing film may be formed of polyester (i.e., Dacron), polyolefin or polyvinyl material, a type which can be ultrasonically bonded or sealed.

In practice, one may use for the crib sheet material soft thermoplastic laminates of the type used in some modern diapers which are absorbent on one side and waterproof on the other.

Preferably, the top layer fibers should have good wicking properties, so that when a child wets a given region of the crib sheet, the moisture absorbed by the face of the sheet is dispersed thereon to facilitate rapid evaporation and the avoidance of a clammy condition that would be uncomfortable to the occupant of the crib.

Because the backing film is waterproof, the underlying mattress is maintained in a dry and sanitary state. The crib sheet fully covers the face, the ends and the sides of the mattress; hence regardless of how wet and soiled the crib sheet gets, the mattress will be isolated therefrom and maintained in a clean, sanitary condition.

To create the crib sheet 13, use is made of a single rectangular blank 17, as shown in FIG. 4, having a pair of parallel longitudinal fold lines $L_1$ and $L_2$ which define the long sides $S_1$ and $S_2$ of the crib sheet and a pair of parallel transverse fold lines $L_3$ and $L_4$ which define the shorter ends $E_1$ and $E_2$ of the crib sheet. The four corners of the blank $C_1$ to $C_4$ formed at the intersections of the longitudinal and transverse fold lines are provided with diagonal fold lines $D_1$ to $D_4$.

The area of blank 17 substantially matches the combined area of the face of mattress 14 and the sides and ends thereof. Hence when blank 17 is folded up on the longitudinal and transverse fold lines $L_1$ to $L_4$ and folded in on the diagonal fold lines $D_1$ to $D_4$ (see FIG. 5) to form right angle corners, this creates the box-like three dimensional structure shown in FIG. 7 whose face, sides and ends are coextensive with those of the crib mattress.

The triangular gussets or folds $F_1$ to $F_4$ formed by folding in the corners of the blank at diagonal fold lines $D_1$ to $D_4$ are ultrasonically sealed to the ends $E_1$ and $E_2$ of the crib sheet along marginal lines $M_1$ to $M_4$ to prevent the corners from unfolding. The triangular folds act to reinforce the right angle corners.

As shown in FIG. 6, ends $E_1$ and $E_2$ are creased to form puckers. Extending across and bridging the puckers is a strip 18 of elastic material which is ultrasonically bonded to the peaks of the puckers and normally maintains the ends of the sheet in the puckered state. However, when the crib sheet is fitted over the crib mattress,the ends of the sheet must then be stretched, thereby subjecting the corners of the crib sheet to tension and causing the sheet to conform snugly to the mattress.

While there has been shown and described a preferred embodiment of a fitted crib sheet in accordance with the invention, it will be appreciated that many changes and modifications may be made therein without, however, departing from the essential spirit thereof.

Thus, while the invention has been described in connection with a crib, it is also applicable to ordinary beds, in which case the fitted sheet is dimensioned to fit snugly over a standard bed mattress. As pointed out previously, the fitted sheet is particularly advantageous when the occupant of the bed is incontinent.

While the backing film included in the fitted sheet material must be liquid-impermeable, it is desirable that it not be vapor-impermeable so that evaporated liquid can escape through the sheet. Thus, use is made for this purpose of vapor permeable plastic films of the type commonly used in raincoats and sportswear to keep the wearer dry while preventing the wearer from becoming clammy. A vapor-permeable and liquidimpermeable backing film reduces sheet dampness, and is therefore preferred to a film which is liquid and vapor-impermeable.

Instead of using ultrasonic welding to bond the triangular folds to the ends of the sheet, bonding may be effected by the application of heat and pressure to the thermoplastic sheet material, or by other bonding means. And instead of using a strip of elastic material to be joined ultrasonically to the puckers in the ends of the fitted sheet, use may be made of "Fullastic" self-adhering elastic ribbons for this purpose, this elastic material being disclosed in U.S. Pat. Nos. 4,259,220 and 4,418,123. This self-adhering elastic, which is produced in translucent ribbon form by H. B. Fuller Company of St. Paul, Minn. provides a flatter tensile/elongation curve than natural rubber or urethane elastic and does away with the need to sew or seal and elastic strip to the puckers.

I claim:

1. A fitted sheet for covering a standard crib or bed mattress, said sheet being created from a single blank having longitudinal and transverse fold lines which when the blank is folded in along these lines define sides and ends that are coextensive to those of the mattress, said blank having at its corners diagonal fold lines which when folded in form triangular folds that are ultrasonically sealed to the ends of the sheet to form reinforced right angle corners, said blank being formed of synthetic plastic flexible material having an absorbent to player laminated to a liquid-impermeable backing layer, whereby when an occupant of the crib or bed wets the sheet, the liquid is absorbed thereby, yet the underlying mattress is maintained in a dry state, each end being creased to form puckers, and an elastic strip ultrasonically joined to the puckers to render the end stretchable to cause the fitted sheet to conform snugly to the mattress.

2. A fitted sheet as set forth in claim 1, wherein said top layer of the blank is constituted by non-woven fibers having good wicking properties.

3. A fitted sheet as set forth in claim 2, wherein said blank is formed of polyester material.

4. A fitted sheet as set forth in claim 2, wherein said blank is formed of polyolefin material.

5. A sheet as set forth in claim 1, wherein said backing layer is vapor-permeable.

* * * * *

UNITED STATES PATENT OFFICE

CERTIFICATE OF CORRECTION

PATENT NO. : 4,704,753

DATED : November 10, 1987

INVENTOR(S) : Audrey T. Lunt

It is certified that error appears in the above-identified patent and that said Letters Patent are hereby corrected as shown below:

Column 4, line 52, "to" (first occurrence) should read --top--; "player" should read --layer--

Signed and Sealed this

Twenty-second Day of March, 1988

*Attest:*

DONALD J. QUIGG

*Attesting Officer*

*Commissioner of Patents and Trademarks*